United States Patent [19]

Nieuwendijk

[11] 4,206,057

[45] Jun. 3, 1980

[54] DREDGING VESSEL

[75] Inventor: Petrus J. H. Nieuwendijk, Muiden, Netherlands

[73] Assignee: Ballast-Nedam Groep N.V. & Amsterdamse Ballast Bagger en Grond (Amsterdam Ballast Dredging) B.V., Amstelveen, Netherlands

[21] Appl. No.: 912,849

[22] Filed: Jun. 5, 1978

[30] Foreign Application Priority Data

Jun. 8, 1977 [NL] Netherlands ..... 7706318

[51] Int. Cl.[2] ..... B01D 43/00

[52] U.S. Cl. ..... 210/523; 414/143; 114/183 R

[58] Field of Search ..... 37/54, 58, 59, 61; 414/142; 214/15 B; 56/8, 9; 114/182, 183 R, 184–186; 210/170, 513, 523

[56] References Cited

U.S. PATENT DOCUMENTS 934,593 9/1909 Carlésimo ..... 37/59

3,698,573 10/1972 Wolters et al. ..... 414/142

FOREIGN PATENT DOCUMENTS 535989 12/1958 Belgium ..... 37/54

*Primary Examiner*—Charles N. Hart

*Assistant Examiner*—E. Rollins Cross

*Attorney, Agent, or Firm*—John P. Synder

[57] ABSTRACT

When loading a loading space 2 of a dredging vessel 1 with sand the head water 5 is removed from the loading space 2 by means of more than one siphon 12 and is conducted away into the water stream 26 moving around the vessel 1. This head water can be polluted with much sludge or another pollutant.

In order to reduce pollution of the environment with the aid of effluent means which are not very expensive and which can be easily adjusted, said effluent means comprises in accordance with the invention a tubular sheath 24, inside which is telescopically arranged a level-adjustable common outlet conduit 21 which can be withdrawn into said tubular sheath and be brought out thereof to a considerable distance below the vessel 1 respectively, and which is connected with coupled conduits 16, 19, 18 of more than one siphon 12.

6 Claims, 4 Drawing Figures

DREDGING VESSEL

The invention relates to a dredging vessel comprising a loading space for receiving spoil, for example, sand and at least two effluent devices for conducting away the head water standing above the settled sand, said effluent devices comprising a conduit having a level-adjustable inlet and an outlet opening out in the outboard water, the inlet of the conduit being adjustable between an inactive position and an active siphon position, whilst the conduits of at least two effluent devices are coupled on board with a coupling conduit opening out in a common outlet conduit.

Such a dredging vessel is known from Dutch patent application no. 6816677.

When the loading space is loaded with comparatively clean sand, there is no objection for the hardly polluted head water to flow directly away into the water stream moving around the vessel. However, when the loading space is filled with sand.containing much sludge or another pollutant, the head water will be seriously polluted, which may result in an unacceptable pollution of the environments when conducted away into the flowing water.

In order to avoid pollution of the environment across a wide region, the head water can be conducted away beyond the stream range around the vessel which is located near the bottom in a quiet stream so that the particles floating in the head water will readily settle on the ground and will not spread over a large region.

From the Japanese patent specification no. 46-9297 of 1971 it is known to provide each overflow of a dredging vessel with an effluent duct that can be lowered as far as below the plane of the vessel. Such a lowerable effluent duct structure is comparatively large and costly to guarantee a low effluent rate. Moreover, the flow through the separate outlet ducts can be controlled only with difficulty.

The invention has for its object to restrict environmental pollution with the aid of a not excessively expensive, readily controllable effluent device. For this purpose the outlet conduit comprises a tubular sheath, inside which is telescopically arranged a level-adjustable, common outlet conduit which can be withdrawn into said tubular sheath and be brought out thereof to a considerable distance below the vessel respectively, and which is connected with the coupled conduits, said level-adjustable, common outlet conduit having an outlet extending, during the loading operation, beneath the vessel and being brought beyond the water stream moving beneath the vessel, and said common outlet conduit being suspended to elevating means extending through the tubular sheath.

In order to ensure such an effluent of a large loading space that during loading the location of the vessel can be checked, a further embodiment is characterized in that at the front and rear ends the loading space is provided with two coupled, downwardly pivotable nozzles which open out through a front coupling conduit and a rear coupling conduit near the bottom of the vessel in a common outlet conduit.

It should be noted that it is known per se, for example, from Dutch patent application no. 6902178 laid open for public inspection to couple a plurality of effluent devices not forming part of the vessel to be loaded, but being associated with a dredging system loading the vessel with a coupling conduit not forming part of the vessel to be loaded and opening out in the common outlet conduit, the outflow nozzle of which is level-variable by being fixedly secured to a suction pipe of said dredging system to be inserted into the ground.

The invention will be described more fully with reference to a preferred embodiment of a dredging vessel in accordance with the invention as shown in the drawing.

Figure 1:
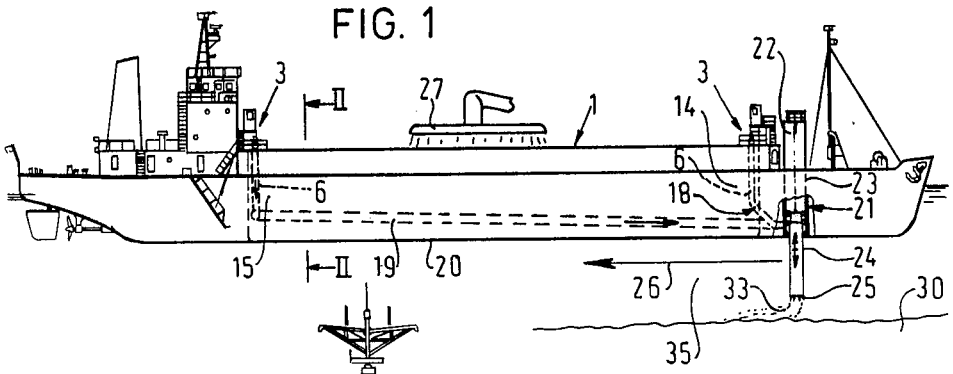
FIG. 1 is a side elevation of the dredging vessel.
Figure 2:
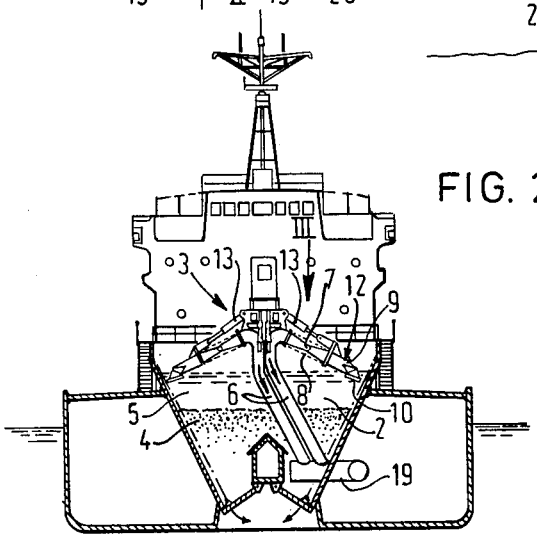
FIG. 2 is an enlarged sectional view taken on the line II—II in FIG. 1.

A dredging vessel 1 comprises a loading space 2 for receiving spoil, for example, sand and at each of the four corners of the loading space 2 an effluent device 3 for conducting away the head water 5 standing above the settled sand 4. Each effluent device 3 comprises a conduit 12 consisting of a fixed tube 6 with an upward bend 11, which is mechanically connected through a hinge 7 with and joined through a flexible length of conduit 8 to a nozzle 9, the inlet 10 of which is level-adjustable, since the nozzle 9 can be lifted by means of a hydraulic ram 13 into an inactive position 9' indicated by dot-and-dash lines and can be displaced into the deepest siphon position 9'' indicated by broken lines. A siphon position 9 is indicated by solid lines. The two effluent devices 3 at the front end 14 comprise nozzles 9, which can be pivoted downwards in common, since their hydraulic rams 13 have common control-means 16, which actuate the rams 13 simultaneously and to the same extent. This also applies to the two effluent devices 3 at the rear end 15 of the loading space 2. The two tubes 6 at the front end 14 and those at the rear end 15 are coupled with a front coupling conduit 18 and a rear coupling conduit 19 respectively, which are located on board and which open out near the bottom 20 of the dredging vessel 1 in an outlet conduit 21 common to all effluent devices 3, said conduit consisting of a fixed wide tube 23 arranged on board and accommodating telescopically a tube 24, which is level-adjustable by elevating means 22 and which has an outlet 25 located, during the loading operation, in the lowered state beneath the dredging vessel 1 and even beyond the water stream 26 moving below the dredging vessel 1, for example, at a depth of 8 to 10 ms beneath the bottom 20 of the dredging vessel 1.

When the loading space 2 of the dredging vessel 1 is loaded, a suspension of mainly sand and water is fed into the loading space 2 from a suspension feeder 27, which may be associated with another dredging tool (not shown). The sand 4 settles down and the water of the suspension will form the head water 5 above the sand. The head water 5, which may contain, in particular, sludge and other impurities and even unsettled sand is conducted out of the loading space 2 by means of the effluent devices 3 described above. It is removed by siphon effect, since the upper bend 11 is located at a higher level than the inlet 10. In order to actuate the siphon the air should be removed at least for the major part from the siphon.

Figure 3:
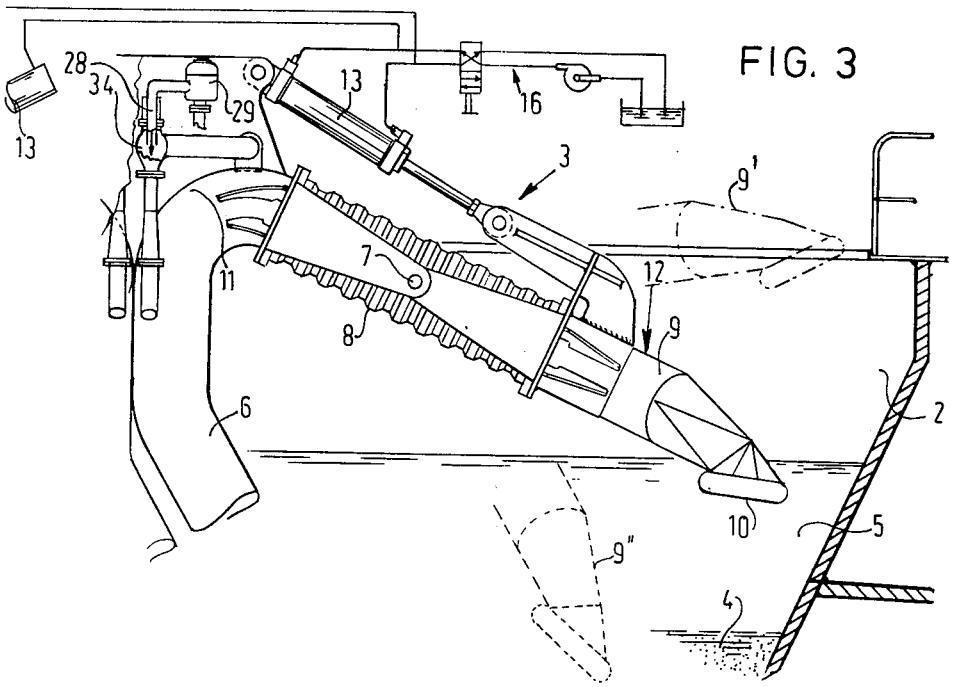
FIG. 3 illustrates on an enlarged scale detail III of FIG. 2.

As shown in FIG. 3 each upper bend 11 is connected with a water jet pump 34, the water spray 28 of which is fed from a water pump 29. At an inlet 10 immersed in the head water 5 vacuum is created in the outlet conduit 12, which starts the siphon operation so that the head water 5 flows through the conduit 12, a coupling conduit 18 or 19 and the common outlet conduit 21 and the outlet 25 into the outboard water 35 below the stream 26 so that the impurities 33 can readily settle on the subaqueous ground 30 and will not be carried along by the stream 26.

Figure 4:
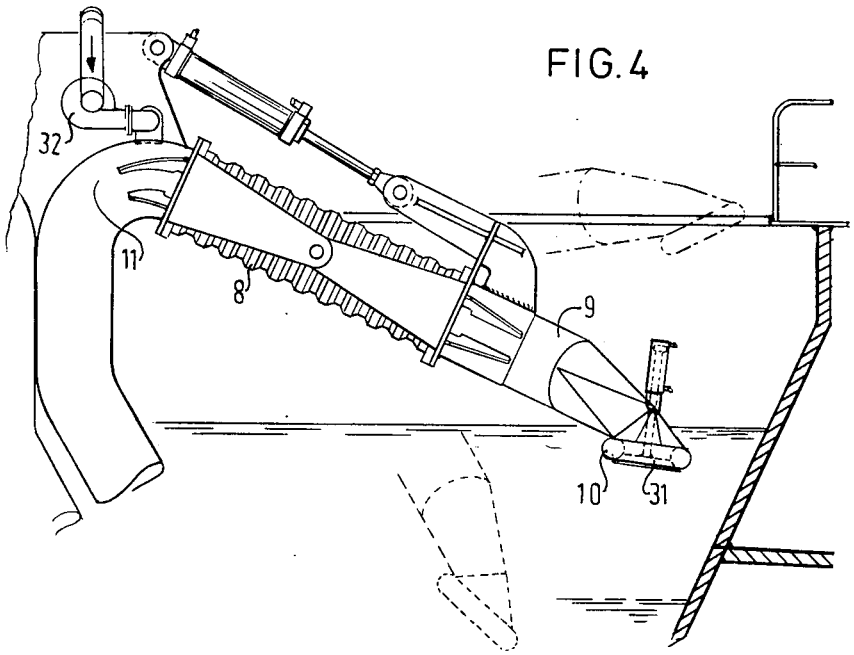
FIG. 4 shows a variant of the detail III of FIG. 2.

Each inlet 10 preferably comprises a flap 31 (FIG. 4), which narrows, by means of a hydraulic ram, the passage of the inlet 10 in an adjustable manner to regulate the head water flow rate through the inlet 10 concerned. This flap 31 may, in addition, be utilised for starting the siphon effect. For this purpose, whilst the flap 31 is closed, water is pumped by a pump 32 into the conduit 12, particularly, into the nozzle 9, the flexible length of conduit 8 and the upper bend 11. The siphon effect and hence the outflow can be stopped by lifting the inlet 10 above the head water 5.

What I claim is:

1. A dredging vessel comprising a hull having a loading space for receiving dredged spoil, for example, sand, and at least two effluent devices for conducting away the head water standing above the settled sand in said space, each effluent device comprising a conduit having a level-adjustable inlet and an outlet, the inlet of the conduit being adjustable between an inactive position above the head water and an active siphon position below the level of said head water, common outlet means connected to the outlet of each effluent device, said common outlet conduit means comprising a vertically extending tubular sheath fixed to said hull to define a well having a bottom opening located below the water line of said hull, inside of which sheath is telescopically arranged a level-adjustable, common outlet conduit which can be withdrawn into said tubular sheath and projected outwardly thereof through said bottom opening to a considerable distance below the vessel respectively, said level-adjustanble, common outlet conduit having an outlet extending, during the loading operation, beneath the vessel and being brought beyond the water stream moving beneath the vessel, and said common outlet conduit being suspended to elevating means extending through the tubular sheath.

2. A dredging vessel as defined in claim 1 wherein there are four effluent devices, one pair at one end of said hull and another pair at the other end of said hull, each pair having a common outlet and the common outlets of the two pairs being connected for simultaneous discharge into said sheath.

3. A dredging vessel as defined in claim 2 wherein said sheath is located adjacent said one pair of devices and including a conduit running lengthwise of said vessel receiving the discharge from said other pair of devices.

4. A dredging vessel comprising, in combination:

a hull adapted to float in water and presenting a loading space for receiving dredged spoil;

a generally vertical sheath connected to said hull and defining an open-bottom well having a bottom opening below the water line of said hull and a top situated well above said water line;

an elongate outlet conduit slidably disposed in said sheath;

means for raising and lowering said outlet conduit within said sheath between a position wherein said outlet conduit is telescoped within said sheath and a position wherein said outlet conduit is projected through said bottom opening of the well to form an extension of said sheath reaching well below the bottom of said hull; and siphon means for discharging head water standing above spoil settled in said space into said well whereby the effluent which is said head water and any material suspended therein is allowed to flow by gravity downwardly through said well and said outlet conduit into the aqueous environment below said hull at that level established by the position of said outlet conduit.

5. A dredging vessel as defined in claim 4 wherein said means for discharging comprises two pairs of siphon heads, one at each end of said vessel, and conduit means connecting said siphon heads to said sheath.

6. A dredging vessel as defined in claim 4 including means for raising and lowering the siphon heads of each pair thereof in unison.

* * * * *